US006678912B1

(12) United States Patent
Ruuska et al.

(10) Patent No.: US 6,678,912 B1
(45) Date of Patent: Jan. 20, 2004

(54) SWEEPING UNIT

(75) Inventors: Mauno Olavi Ruuska, Vammala (FI); Janko Tuskan, Furtwangen (DE); Clemens Rosa, Grafenhausen (DE)

(73) Assignees: Schmidt Holding GmbH, Blasien (DE); Patria Vammas Oy, Vammala (FI)

( * ) Notice: Subject to any disclaimer, the term of this patent is extended or adjusted under 35 U.S.C. 154(b) by 323 days.

(21) Appl. No.: 09/763,284

(22) PCT Filed: Jun. 15, 2000

(86) PCT No.: PCT/EP00/05486

§ 371 (c)(1),
(2), (4) Date: Apr. 12, 2001

(87) PCT Pub. No.: WO00/79058

PCT Pub. Date: Dec. 28, 2000

(30) Foreign Application Priority Data

Jun. 17, 1999 (DE) ..... 199 27 592

(51) Int. Cl.[7] ..... E01H 1/00; E01H 1/05; A47L 13/00

(52) U.S. Cl. ..... 15/82; 15/78; 15/52.1

(58) Field of Search ..... 15/78, 82, 52.1

(56) References Cited

U.S. PATENT DOCUMENTS 5,015,300 A * 5/1991 Leers ..... 134/18
5,369,832 A * 12/1994 Hagger ..... 15/83
5,426,805 A * 6/1995 Fisher ..... 15/79.2

FOREIGN PATENT DOCUMENTS

| | | |
|---|---|---|
| DE | 2455200 | 5/1976 |
| DE | 2821627 | 11/1979 |
| DE | 3740215 | 6/1988 |
| EP | 0189371 | 7/1986 |
| EP | 0372258 | 6/1990 |
| EP | 0843047 | 5/1998 |

OTHER PUBLICATIONS

Derwent Publication 1993–046855, English translation of Abstract of DE 3740215 to Leers.*

* cited by examiner

*Primary Examiner*—Robert J. Warden, Sr.
*Assistant Examiner*—Laura C Cole
(74) *Attorney, Agent, or Firm*—Jordan and Hamburg LLP

(57) ABSTRACT

A sweeping unit which can be affixed to a carrier vehicle or a trailer, comprising a supporting frame and at least one motor-driven rotary brush which is rotationally mounted around the longitudinal axis thereof. The supporting frame is provided with supporting wheels, whereby the vertical distance of said wheels from the axis of the rotary brush can be modified by means of an adjusting device comprising at least one adjusting member and a control unit. A sensor is provided for the detection of driving torque or the driving power of the rotary brush or an associated variable, whereby the signal from said sensor is switched to the control unit. The control unit determines the working position of the adjusting member corresponding to an optimum contact surface between the brush and the ground as a function of the contact position between the ground and the adjusting member, characterized by a sharp increase in said sensor signal when the rotary brush is lowered.

8 Claims, 1 Drawing Sheet

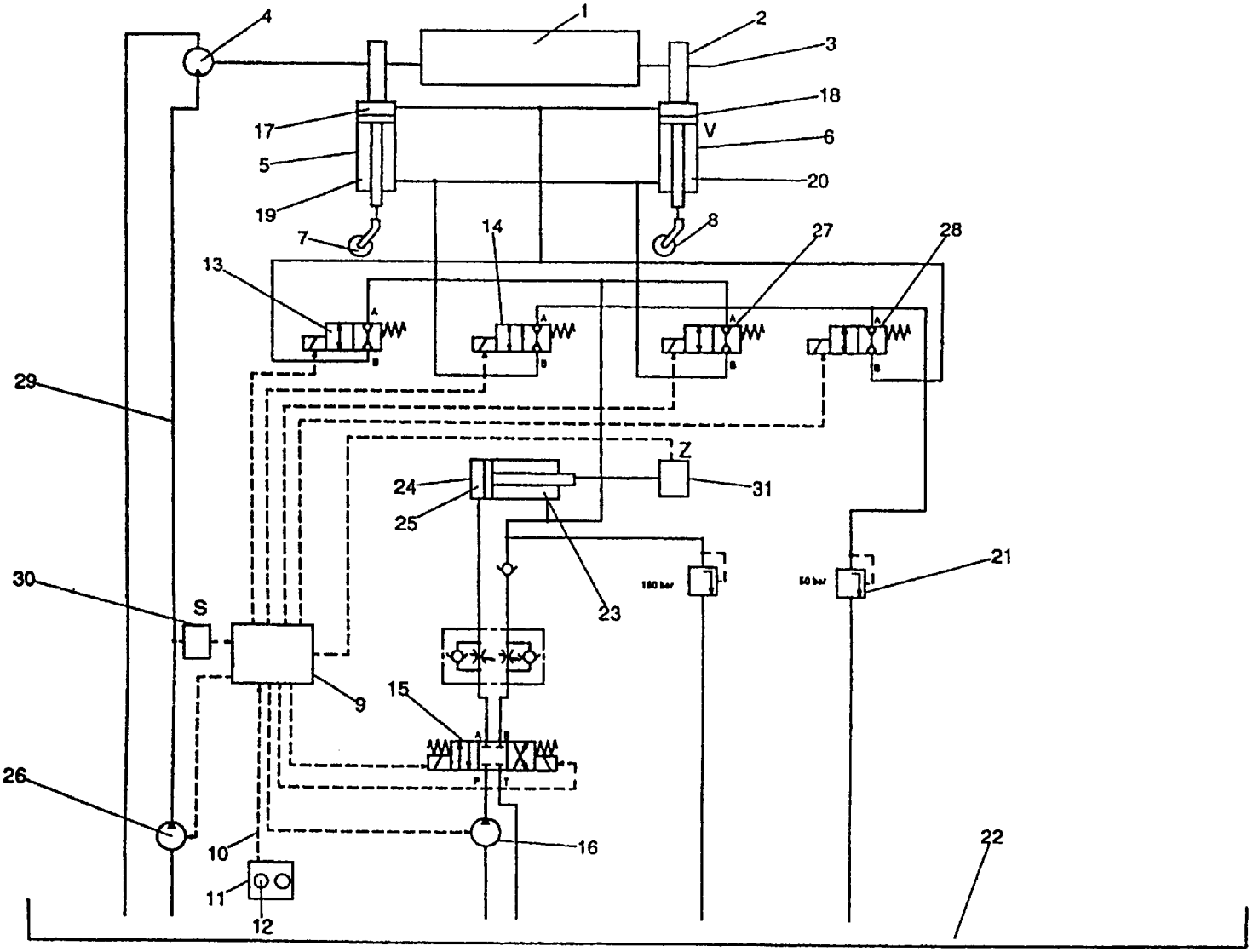
1
2
3
4
5
6
7
8
9
10
11
12
13
14
15
16
17
18
19
20
21
22
23
24
25
26
27
28
29
30
31
V
Z
S
50 bar
100 bar

SWEEPING UNIT

BACKGROUND OF THE INVENTION

The present invention relates to a sweeping unit for mounting on a carrier vehicle or on a trailer, comprising a carrying frame and at least one motor-driven rotary brush mounted in said carrying frame such that it can be rotated about its longitudinal axis, the carrying frame having supporting wheels, of which the vertical distance from the axis of the rotary brush can be changed by means of an adjusting unit, which comprises at least one adjusting element and a control apparatus.

Various designs of sweeping units of the type specified above are known, for example from European Patent 0372258 and German Offenlegungsschrift 3740215. Also known are sweeping units which have a construction essentially of the generic type, but differ therefrom in that the adjusting element, rather than being set via control apparatus, is part of a hydraulic regulating circuit, and in that, furthermore, the carrying frame does not have supporting wheels; such sweeping units can be gathered, for example, from German Offenlegungsschriften 2455200 and 2821627 and European Patent Applications 0189371 and 0843047.

For all the sweeping units known from the publications specified above, the correct setting of the sweeping-level width is extremely important for an efficient sweeping operation which, at the same time, does not adversely affect the materials. Thus, as is explained in detail in European Patent 0372258, the optimum sweeping-level width is characterized by a good cleaning result with a low level of bristle wear. If the sweeping-level width is below the optimum value, the cleaning capacity can noticeably decrease. With a sweeping-level width above the optimum value, in contrast, the bristle wear noticeably increases without any notable improvement to the cleaning result.

In order for the sweeping-level width to be set to its optimum value for the purposes explained above, it is necessary, inter alia, for the rotary brush to be adjusted in accordance with the bristle wear, i.e. for the distance between the axis of the rotary brush and the surface which is to be cleaned to be reduced gradually in accordance with the bristle wear. For this purpose, German Offenlegungsschriften 2455200 and 2821627 and European Patent Application 0843047 propose that the control apparatus of the adjusting unit acts on the adjusting element such that the driving torque for the rotary brush is always constant. According to German Offenlegungsschrift 3740215 and European Patent 0372258, on the other hand, the current diameter of the rotary brush (said diameter being dependent on the bristle wear) is measured by means of sensors and, in dependence on this measured value, the optimum distance between the axis of the rotary brush and the surface which is to be cleaned is determined and set. Finally, a time control means, in the case of which the running performance of the respective rotary brush, said performance being determined by an elapsed time meter, is evaluated as an indicator of the wear of said rotary brush and thus as a measure of the necessary adjustment, is known. None of the methods here is free of disadvantages. The sensing of the current diameter of the rotary brush by means of sensors requires a complicated measuring-sensor arrangement, which does not permanently withstand the harsh winter-service operations. Furthermore, the sensing element may ice up in unfavorable weather conditions and, consequently, indicates a rotary-brush diameter which is larger than the actual diameter. This results in an unsatisfactory cleaning result because the rotary brush is operated at too large a distance from the ground. The most serious disadvantage of the methods based on a constant driving torque is that the set sweeping-level width depends to an undesirable extent on the surface conditions, in particular the surface roughness; this means that, for example with surfaces made of concrete, a smaller sweeping-level width is set, on account of the greater friction, than for surfaces made of asphalt. Correspondingly, firmly adhering dirt such as loam and the like undesirably reduce the sweeping-level width, on account of the pronounced braking torque to which the rotary brush is subjected, as a result of which the cleaning result is adversely affected. The time control of the adjustment movement, since it only takes account of average wear conditions rather than the actual bristle wear which is dependent on the individual use conditions, is relatively imprecise.

Against the backdrop of the prior-art disadvantages explained above, the object of the present invention is to provide a sweeping unit of the generic type in which the optimum sweeping level can be set precisely with the lowest possible outlay, the intention being, furthermore, for the sweeping unit to be distinguished by a robust construction which is not susceptible to malfunctioning.

SUMMARY OF THE INVENTION

This object is achieved according to the present invention in that there is provided a sensor which senses the driving torque or the driving power of the rotary brush, or a variable linked thereto, and of which the signal is switched to the control apparatus, the control apparatus determining the operating position of the adjusting element, said operating position corresponding to the optimum sweeping-level width, as a function of the ground-contact position of the adjusting element, said ground-contact position being characterized, during lowering of the rotary brush, by an abrupt rise of the sensor signal.

In the sweeping unit according to the invention, the actual rotary-brush diameter, which is dependent on the bristle wear, is automatically taken into account for setting the position of said rotary brush relative to the surface which is to be cleaned, in that during the individual sweeping operation, the ground contact of the rotary brush and the corresponding ground-contact position of the adjusting element are used as reference points for the operating position of the adjusting element, said operating position corresponding to the optimum sweeping-level width. The ground contact of the rotary brush, during lowering of the latter, is determined here by an abrupt rise of the sensor signal which is emitted by a sensor which senses the driving torque or the driving power of the rotary brush or a variable linked thereto.

Problems of the type explained above in conjunction with the prior art do not arise in a sweeping unit according to the present invention. The sweeping-level width set by the control apparatus is not dependent on the surface conditions, in particular the roughness of the surface which is to be cleaned, nor is a complicated measuring-sensor arrangement which is susceptible to malfunctioning necessary. Nevertheless, the setting of the sweeping-level width is based not on an average degree of rotary-brush wear, which is dependent on the running performance of the relevant rotary brush, but on the actual degree of wear. Consequently, the present invention provides a sweeping unit in which the optimum sweeping level can automatically be set precisely with extremely low outlay on apparatus, the sweeping unit, furthermore, being distinguished by a robust construction which is not susceptible to malfunctioning.

The present invention can advantageously be used if the operating position of the adjusting element is determined, in the control apparatus, from the ground-contact position of the adjusting element by the addition of a constant variable. In this case, in other words, the rotary brush, during the sweeping operation, would be lowered in each case into a position which is located a certain distance (e.g. 2 mm) below the ground-contact position. Although, as a result of the geometrical relationships, this would result, with continuing wear of the rotary brush, in a gradual reduction in the sweeping-level width, it would be compensated—at least partially—by an increasing hardness of the brush, so that the cleaning result would essentially stay the same.

In contrast, however, a preferred development of the present invention is distinguished in that the adjusting-element advancement movement, by means of which the operating position of the adjusting element differs from the ground-contact position thereof, is dependent on the actual diameter of the rotary brush. In this case, the control apparatus comprises a corresponding compensation circuit, for example in the form of a characteristic curve, which specifies the advancement movement, i.e. the difference between the operating position and ground-contact position of the adjusting element, in dependence on the actual diameter of the rotary brush. This actual diameter may be derived directly from the ground-contact position of the adjusting element since—with supporting wheels resting on the surface which is to be cleaned—each diameter of the rotary brush has precisely one ground-contact position of the adjusting element corresponding to it. Other suitable measuring devices which are intended for determining the diameter of the rotary brush, and likewise evaluate the position of the rotary brush relative to the carrying frame in the ground-contact position of the rotary brush, can be used in the same way. These include, in particular, an angle-measuring instrument which determines the angular position of at least one carrying arm of the rotary brush relative to a further component of the carrying frame. The critical factor is that the diameter of the rotary brush, rather than being measured directly—via sensors—in each case, is derived from the position of the rotary brush at the moment at which it comes into contact with the ground, and thus indirectly utilizing the signal of the ground-contact sensor.

A preferred development of the sweeping unit according to the invention is distinguished in that the at least one adjusting element is designed as a hydraulic adjusting cylinder. In this case, there is particularly preferably hydraulically connected to the adjusting cylinder a supply cylinder, of which the hydraulic operating chamber, which communicates with the adjusting cylinder, has a smaller cross-sectional surface area than the at least one adjusting cylinder. The supply cylinder serves here for the volumetric proportioning of the hydraulic fluid to the at least one adjusting cylinder, this corresponding to the advancement movement of the adjusting cylinder from its ground-contact position into its operating position. A bypass line to the supply cylinder is particularly preferably provided since said supply cylinder is required merely for the precise lowering of the rotary brush from its ground-contact position into its operating position. There is no need for a volumetric determination of the hydraulic fluid volume which is fed to the at least one adjusting cylinder or flows out of the same, either during lowering of the rotary brush into its ground-contact position or during raising of the rotary brush, respectively. The abovementioned configuration of a hydraulic system with a supply cylinder results in it being possible for the at least one adjusting cylinder to be set particularly precisely.

Although it is conceivable, within the context of the abovementioned development of the present invention, for a mechanical adjusting drive to act on the piston of the supply cylinder, with the result that the supply cylinder itself performs the function of a pump, it is particularly preferable for the supply cylinder to be connected between a hydraulic pump and the at least one adjusting cylinder. It follows along in this case, the volume of the hydraulic fluid fed to the at least one adjusting cylinder being determined by the number of strokes of the supply cylinder and/or—in the case of incomplete strokes—by the displacement of the piston of the supply cylinder.

BRIEF DESCRIPTION OF THE DRAWING

FIG. 1 shows the hydraulic circuit diagram.

DETAILED DESCRIPTION OF THE PREFERRED EMBODIMENT

The sweeping unit illustrated in the drawing comprises a rotary brush 1 which is mounted within a carrying frame 2 such that it can be rotated about its axis 3, and is driven by a hydraulic motor 4. The carrying frame 2, for its part, comprises two hydraulic adjusting cylinders 5 and 6, which form the adjusting elements V, the piston rod of each of the two hydraulic adjusting cylinders each being connected to a supporting wheel 7 or 8. The supporting wheels are coupled mechanically, which guarantees a uniform movement even if the weight is not constant over the roller length. The design—only schematically illustrated—is such that the vertical distance between the supporting wheels 7, 8 and the axis 3 of the rotary brush 1 can be changed by means of the adjusting cylinders 5 and 6. Such designs are known to a sufficient extent, so that there is no need for them to be explained in any more detail.

The sweeping unit itself is suspended on a carrier vehicle by means of a carrying arrangement—not illustrated. The carrying arrangement here allows the sweeping unit to be raised into a transporting position and lowered into an operating position, in which the supporting wheels 7 and 8 roll on the surface which is to be cleaned. This also forms part of the prior art and thus need not be explained here.

The functioning of the sweeping units is controlled by a control apparatus 9. The latter is connected to the operating point 11 via a control line 10. If the sweeping unit is in operation via a corresponding switch 12 at the operating point 11, the following steps proceed within the hydraulics controlled by the control apparatus 9.

The valves 13 and 14 are switched from their blocking position into their throughflow position, the control valve 15 is switched from its blocking position into its crossover position, in which it connects to one another the connections P and B, on the one hand, and A and T on the other hand, and the pump 16 is set in operation. In this way, the hydraulic operating chambers 17, 18 of the adjusting cylinder 5 and 6 are filled with hydraulic fluid, and the piston rods of the adjusting cylinders are extended into their maximum position, the hydraulic fluid which is present in the hydraulic operating chambers 19 and 20 being displaced into the sump 22 in the process via the valve 14 and the backpressure valve 21. (A reverse arrangement of the adjusting cylinders, in which the rotary brush is raised by the rod sides of the adjusting cylinders being filled, is possible in the same way.)

At the same time, the hydraulic operating chamber 23 of the supply cylinder 24 is filled, as a result of which the piston of the supply cylinder is brought into its left-hand end position, the hydraulic fluid which is present in the hydraulic operating chamber 25 being displaced into the sump 22 in the process via the control valve 15. Then the valves 13 and 14 are brought into their locking position, and the sweeping unit is lowered, by means of the carrying apparatus (not illustrated), until the supporting wheels 7 and 8 rest on the surface which is to be cleaned. The carrying apparatus is then switched into its floating position in order that the sweeping unit can follow unevennesses in the ground.

The hydraulic pump 26 which drives the hydraulic motor 4 is then switched on, with the result that the rotary brush 1 is made to rotate.

Furthermore, the valves 27 and 28 are switched into their throughflow position. In this way, hydraulic fluid passes into the hydraulic operating chambers 19 and 20 of the adjusting cylinders 5 and 6 via the pump 16 and the control valve 15, which is still switched into its crossover position. The piston rods of said adjusting cylinders retract slowly, the hydraulic fluid which is present in the hydraulic operating chambers 17 and 18 being displaced into the sum p 22 via the (open) valve 28 and the backpressure valve 21. This results in the sweeping roller 1 being lowered gradually in the direction of the surface which is to be cleaned.

As soon as the rotary brush 1, within the context of this lowering movement, comes into contact with the surface which is to be cleaned and, in this way, is braked beyond the idling braking torque, the pressure in the pressure line 29, which connects the hydraulic pump 26 and the hydraulic motor 4 to one another, rises abruptly. This rise in pressure is registered by the sensor S, in the form of a pressure sensor 30, which switches a corresponding signal to the control apparatus 9. The control apparatus then switches the control valve 15 from its crossover position into its parallel through-passage position, in which it connects to one another the connections A and P, on the one hand, and B and T on the other hand. The hydraulic operating chamber 25 of the supply cylinder 24 is acted upon as a result, and the hydraulic fluid which is present in the hydraulic operating chamber 23 is displaced into the hydraulic operating chambers 19 and 20 of the adjusting cylinders 5 and 6 via the (open) valve 27. The predetermined volume of the hydraulic operating chamber 23 of the supply cylinder 24 results in a precisely defined shortening of the adjusting cylinders 5 and 6, and thus in a precisely defined lowering of the rotary brush 1.

If the optimum sweeping-level width has not yet been reached, the two valves 27 and 28 are closed and the control valve 15 is brought into its crossover position. As a result, the hydraulic operating chamber 23 of the supply cylinder 24 is filled with hydraulic fluid again and the above-described operation—opening of the valves 27 and 28 and changeover of the control valve 15 into its parallel through-passage position—can be repeated.

The number of strokes of the supply cylinder 24 which are necessary in order to bring the rotary brush 1 from its ground-contact position into its operating position depend, in particular, on the hydraulic reduction ratio between the supply cylinder 24 and the adjusting cylinders 5 and 6. The greater the reduction ratio, the more precisely is it possible to set the position of the rotary brush 1 relative to the surface which is to be cleaned. The piston rod of the supply cylinder 24 acts on a counting device Z in the form of a pulse counter 31, which is connected to the control apparatus 9. If the number of strokes determined by the pulse counter 31 corresponds to the value predetermined by the control apparatus 9, all the valves 13, 14, 27 and 28 and the control valve 15 are closed and the hydraulic pump 16 is switched off.

At the end of the sweeping operation, via a corresponding switch on the operating console 11, the hydraulic pump 26 is switched off and the sweeping unit is raised via the carrying arrangement—not illustrated. This can be followed by the pistons of the adjusting cylinders 5 and 6 being extended, as explained above, by action on the hydraulic operating chambers 17 and 18 thereof. This step may then be omitted at the beginning of the sweeping operation.

What is claimed is:

1. A sweeping unit, comprising:

a carrying frame including supporting wheels;

at least one motor-driven rotary brush mounted in said carrying frame such that said rotary brush can be rotated about a longitudinal axis thereof;

an adjusting unit for adjusting a vertical distance of the supporting wheels from the longitudinal axis of the rotary brush, the adjusting unit comprising at least one adjusting element and a control apparatus; and a sensor which senses at least one of a driving torque of the rotary brush, a driving power of the rotary brush, and a physical variable indicative of the driving torque and driving power, and generates a corresponding sensor signal which is fed to the control apparatus, the control apparatus determining an operating position of the adjusting element, said operating position corresponding to an optimum sweeping-level width, as a function of a ground-contact position of the adjusting element, said ground-contact position being recognized during lowering of the rotary brush by an abrupt rise of the sensor signal.

2. The sweeping unit as claimed in claim 1, further comprising a measuring arrangement for determining a diameter of the rotary brush and generating a corresponding diameter signal which is fed to the control apparatus.

3. The sweeping unit as claimed in claim 1 or claim 2, wherein the at least one adjusting element comprises a hydraulic adjusting cylinder.

4. A sweeping unit, comprising:

a carrying frame including supporting wheels;

at least one motor-driven rotary brush mounted in said carrying frame such that said rotary brush can be rotated about a longitudinal axis thereof;

an adjusting unit for adjusting a vertical distance of the supporting wheels from the longitudinal axis of the rotary brush, the adjusting unit comprising at least one adjusting element and a control apparatus;

a sensor which senses at least one of a driving torque of the rotary brush, a driving power of the rotary brush, and a physical variable indicative of the driving torque and driving power, and generates a corresponding sensor signal which is fed to the control apparatus, the control apparatus determining an operating position of the adjusting element, said operating position corresponding to an optimum sweeping-level width, as a function of a ground-contact position of the adjusting element, said ground-contact position being recognized during lowering of the rotary brush by an abrupt rise of the sensor signal; and a supply cylinder having a hydraulic operating chamber delimited by a piston, said hydraulic operating chamber being hydraulically connected to the at least one adjusting cylinder, said hydraulic operating chamber having a smaller cross-sectional surface area than the at least one adjusting cylinder.

5. The sweeping unit as claimed in claim 4, further comprising a hydraulic pump, the supply cylinder being connected between the hydraulic pump and the at least one adjusting cylinder.

6. The sweeping unit as claimed in claim 5, further comprising a changeover value between the hydraulic pump and the supply cylinder, the changeover valve permitting action directly on the at least one adjusting cylinder, with the supply cylinder being bypassed.

7. The sweeping unit as claimed in claim 4, further comprising a measuring device connected to the piston of the supply cylinder winch generates a measuring signal corresponding to at least one of a count and displacement measured the measuring signal generated by the measuring device being fed to the control apparatus.

8. The sweeping unit as claimed in claim 7, further comprising a mechanical adjusting drive which acts on the piston of the supply cylinder.

* * * * *